US005185624A

United States Patent [19]

Fischer

[11] Patent Number: 5,185,624

[45] Date of Patent: Feb. 9, 1993

[54] RACK FOR AUTOMATIC FILM PROCESSORS

[75] Inventor: Warren Fischer, St. Charles, Ill.

[73] Assignee: Fischer Industries, Inc., Geneva, Ill.

[21] Appl. No.: 705,935

[22] Filed: May 28, 1991

[51] Int. Cl.[5] ..... G03D 3/08

[52] U.S. Cl. ..... 354/132 D

[58] Field of Search ..... 354/319, 320, 321, 323, 354/324; 134/64 R, 122 R, 64 P, 122 P

[56] References Cited

U.S. PATENT DOCUMENTS

| | | | |
|---|---|---|---|
| 3,610,131 | 11/1973 | Beck | 354/234 |
| 4.148.274 | 4/1979 | Stiévenart et al. | 354/317 |
| 4,945,934 | 8/1990 | Vaughan IV | 134/64 R |

*Primary Examiner*—Michael L. Gellner
*Assistant Examiner*—D. Rutledge
*Attorney, Agent, or Firm*—Polster, Lieder, Woodruff & Lucchesi

[57] ABSTRACT

The rack of the invention consists of a hard plastic extrusion having a bowed profile. The bow shape creates a basin that better retains the solution on the rack. The rack is comprised of three sections where the middle section is bowed slightly more than the outer sections to enhance the rack's ability to retain liquid. Enlarged slots are formed in the rack through which the liquid solution is pumped and a plurality of apertures have been added to the middle section of the rack to facilitate the flow of solution through the rack.

10 Claims, 1 Drawing Sheet

RACK FOR AUTOMATIC FILM PROCESSORS

BACKGROUND OF THE INVENTION

This invention relates, generally, to automatic film processors and, more particularly, to the transport racks therefor.

As is known in the art, one such automatic film developer apparatus is the so called straight-through type. In this machine, the film is conveyed along a straight horizontal path through the developer by spaced pairs of transport rollers. As the film is conveyed through the developer, it is sequentially immersed in a developer solution, a fixer solution and a wash solution. Thereafter, the film is passed by a drier before being dispensed from the developer.

In the straight-through machines, a quantity of developer, fixer and wash solutions are held in separate tanks located between adjacent pairs of rollers Disposed over each of the tanks is an upper and lower rack spaced from one another so that the film can pass between the racks. The solutions are pumped from the tanks through the lower rack and into the space between the upper and lower racks to create a reservoir of fluid through which the film passes as it is conveyed through the developer. The solutions run off of the racks such that they are continuously recirculated between the racks and the tanks. The lower racks consist of generally planar extruded plastic members having relatively narrow slots formed therein for allowing the solutions to be pumped therethrough.

One problem with the known racks is that it is difficult to keep them properly wetted. If the racks are not properly wetted with solution the film will contact the dry rack surface. This contact results in the scratching and/or of the film as it passes through the developed. These scratching and marking problems are most acute at the developer solution stage of the developer when the film is in its softest and most sensitive condition; however, the film can be damaged by contact with the racks at any stage.

Thus, a rack for a straight through automatic film developer apparatus that can be maintained in a properly wetted condition is desired.

SUMMARY OF THE INVENTION

The lower rack of the invention overcomes the above-noted shortcomings of the prior art and consists of a hard plastic extrusion having a bowed profile. The bow shape creates a basin that better retains the solution between the racks. Specifically, the rack is comprised of three bowed sections where the middle section is bowed slightly more than the outer sections to enhance the rack's ability to retain liquid. The slots formed in the rack through which the solution is pumped ar larger than in the prior art racks and a plurality of apertures have been added in the middle of the rack to facilitate the flow of solution therethrough.

DETAILED DESCRIPTION OF THE INVENTION

Figure 1:
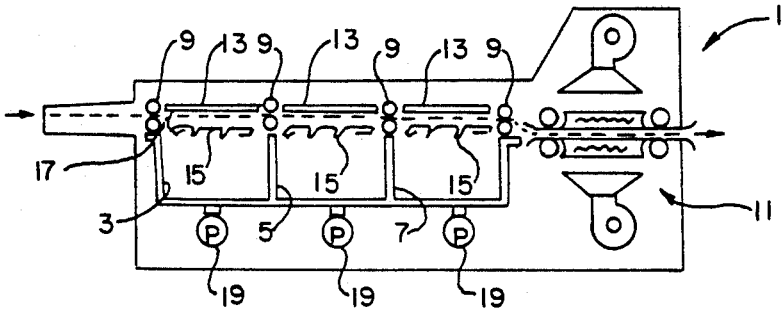
FIG. 1 is a section-view of a straight-through automatic film developer apparatus having the rack of the invention mounted therein.

Referring more particularly to FIG. 1, a typical straight-through film developer is shown generally at 1 consisting of tanks 3, 5 and 7 for retaining developer solution, fixer solution and wash solution, respectively. A plurality of driven roller pairs 9 convey the film through the developer apparatus above the tanks along the path shown by the dotted line. A drier assembly 11 is disposed after wash tank 7 to dry the film before it is discharged from the developer.

Located between adjacent roller pairs and disposed stainless steel and consist of a planar area disposed parallel to 13. Racks 13, as is known in the art, are constructed of stainless steel and consist of a planar area disposed parallel to the path of travel of the film. The planar area is, preferably, formed with a plurality of dimples to create a pebbled surface that helps to retain the water between the upper rack 13 and lower rack of the invention 15.

The lower racks of the invention 15 are also arranged between the adjacent pairs of rollers and are disposed so as to lie substantially parallel to upper racks 13. The lower racks 15 are arranged such that an arrow gap 17 is created between the upper and lower racks through which the film passes.

A pump 19 is associated with each of the tanks 3, 5 and 7 to continuously pump solution from its respective tank into the area between the upper and lower racks. As long as gap 17 is kept filled with solution, the film passes between the upper or lower racks without contacting either.

Figure 2:
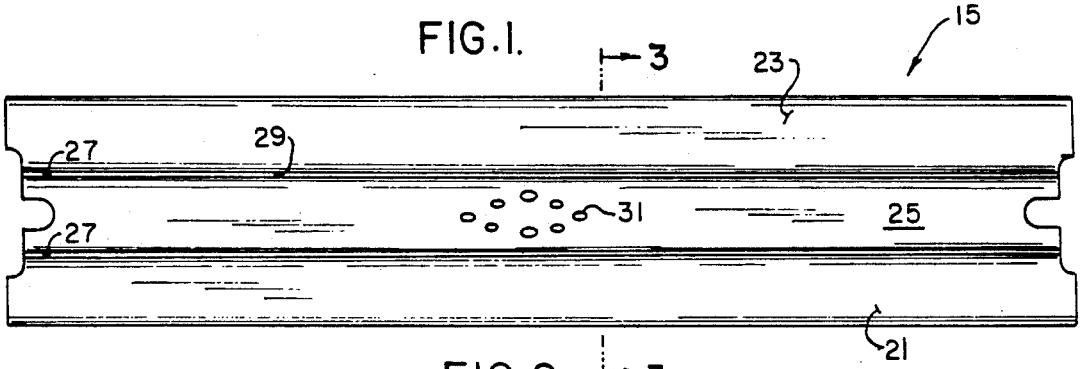
FIG. 2 is a top view of the rack of the invention.
Figure 3:
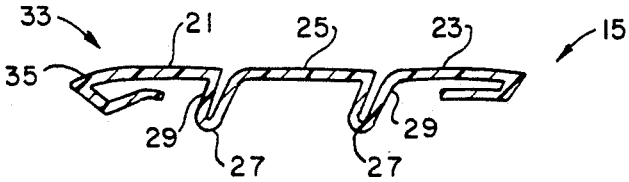
FIG. 3 is a section view taken along line 3—3 of FIG. 2.
Figure 4:
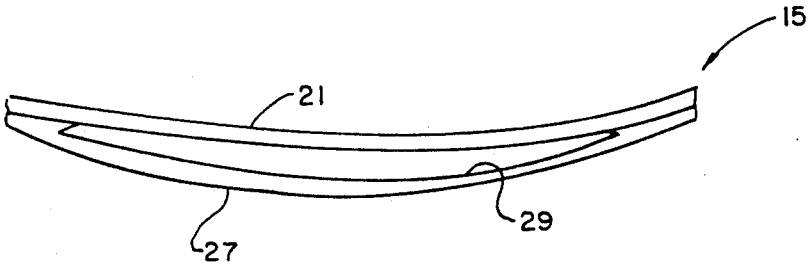
FIG. 4 is a front view of the rack of the invention.

To enhance the ability of the system to maintain solution in gap 17, the lower rack of the invention, shown in greater detail in FIGS. 2–4, has been developed. The lower rack of the invention 15 consists of a piece of extruded hard plastic having a generally rectangular shape. As best shown in FIGS. 2 and 3, rack 15 is formed in three sections -- outer sections 21 and 23 and inner section 25 The sections ar joined together by integrally formed recessed portions 27 having elongated apertures 29 formed therein which extend for the substantially the length of the recessed portions 27.

The entire bottom rack 15 is bowed about a first axis, best shown in FIG. 4, such that the center of the rack is disposed lower than the ends. Moreover, the inner section 25 is bowed to a greater extent than the outer sections 21 and 23 such that the inner section 25 is disposed lower than the outer sections 21 and 23 as best shown in FIG. 3. As a result, the rack 15 also has a slightly bowed shape about a second axis perpendicular to the first axis as best shown in FIG. 2.

As a result of the bowed shape of the rack of the invention, rack 15 has a generally concave shape that acts to create a reservoir or basin in the bottom of the rack for better retaining solution thereon. Moreover, because the inner section 25 is bowed to a greater extent than outer sections 21 and 23, the passages 29 formed in sections 27 will be enlarged to allow a greater flow of solution through rack 15 into gap 17. Holes 31 are also formed in inner section 25 to facilitate the passage of solution through the rack.

Referring m .:e particularly to FIG. 3, the leading edge 33, i.e. the edge which faces the entrance to the developer, is formed with a downwardly sloping tip 35. Tip 35 is designed to avoid contacting the film as it is conveyed through the developer to minimize the risk of damaging the film.

Because of the openings 31 and the wider passages 29, greater amounts of solution can be pumped into space 17. Moreover, the bowed shape of rack 15 retains a greater amount of solution in the space and minimizes dry spots that can damage the film.

It is to be understood that the foregoing specification and drawings have been offered merely by way of example and that the invention is to be limited in scope only by the appended claims.

What is claimed is:

1. A rack for use in an automatic developer apparatus of the type having at lest one tank for holding a solution, a roller assembly for conveying film over the tank and a pump for delivering the solution in the tank over the rack, comprising:

a substantially planar member bowed along a first axis to create a basin for retaining solution thereon, said member further including an inner section and two outer sections integrally connected to said inner section, said inner section having a greater bow formed therein than said outer sections such that at at lest the center of the rack, the inner section is disposed below the outer sections.

2. The rack according to claim 1, further including portions of said inner section defining a plurality of holes.

3. The rack according to claim 2, wherein said rack is disposed above said tank.

4. A film developer apparatus comprising:

a) at least one tank for holding a quantity of solution;

b) a lower rack disposed immediately above said tank comprising a member bowed along a first axis to define a basin for retaining solution therein;

said lower rack including an inner portion and two outer portions, said inner portion having a greater bow formed therein than said outer portions such that the inner portion is at least partially disposed below said outer portions;

c) means for conveying the film over the lower rack; and d) means for delivering solution from the tank over the lower rack such that the film is immersed in solution as it passes over said rack.

5. The film developed apparatus according to claim 4, said rack being bowed along a second axis perpendicular to said first axis.

6. The film developer apparatus according to claim 5, said in portion defining a plurality of holes which allow solution to pass through the rack.

7. The film developer apparatus according to claim 6, further including an upper rack disposed above and spaced from said lower rack.

8. A rack for use in a film developer apparatus, comprising:

a) a first portion bowed about a first axis;

b) second and third portions integrally attached to either side of the first portion and being bowed about said first axis less than said first portion such that the first portion is disposed below the second and third portions; and c) portions of said rack defining apertures for allowing developer solution to pass therethrough.

9. The rack as defined in claim 8, wherein said first, second and third sections are bowed around a second axis perpendicular to said first axis.

10. A film developed apparatus comprising:

a) at least one tank for holding a quantity of solution;

b) a lower rack disposed immediately above said tank comprising a member bowed along a first axis to define a basin for retaining solution therein;

said lower rack including an inner portion and two outer portions, said inner portion having a greater bow formed therein than said outer portions such that the inner portion is at least partially disposed below said outer portions;

c) means for connecting said inner portion to said outer portion and defining apertures for allowing solution to pass through said rack;

d) means for conveying film over the rack; and e) means for delivering solution from the tank over the lower rack such that the film is immersed in solution as it passes over said rack.

* * * * *

UNITED STATES PATENT AND TRADEMARK OFFICE

CERTIFICATE OF CORRECTION

PATENT NO. : 5,185,624

DATED : Feb. 9, 1993

INVENTOR(S) : Warren Fischer

It is certified that error appears in the above-indentified patent and that said Letters Patent is hereby corrected as shown below:

Column 1, line 37, after "and/or" add -- marking --.
Column 1, line 37, now "developed" should be -- developer --.
Column 2, lines 14 and 15, delete "stainless steel and consist of a planar area disposed parallel to 13" and insert therefor -- above the path traveled by the film are the upper wetting racks 13 --.

Column 3, line 14, now "lest" should be -- least --.
Column 3, line 24, now "at at lest" should be -- at least --.
Column 4, claim 5, line 4, now "developed" should be -- developer
Column 4, claim 6, line 8, now "in" should be -- inner --.
Column 4, claim 10, line 26, now "developed" should be -- developer --.

Signed and Sealed this

Seventh Day of June, 1994

*Attest:*

Bruce Lehman

BRUCE LEHMAN

*Attesting Officer*

*Commissioner of Patents and Trademarks*